United States Patent [19]

Mozena

[11] Patent Number: 4,527,344

[45] Date of Patent: Jul. 9, 1985

[54] CLEATED SHOES

[76] Inventor: John D. Mozena, 14385 SW. Walker Rd., #B9, Beaverton, Oreg. 97006

[21] Appl. No.: 495,268

[22] Filed: May 17, 1983

[51] Int. Cl.[3] ..... A43B 5/00

[52] U.S. Cl. ..... 36/126; 36/67 A; 36/134

[58] Field of Search ..... 36/126, 127, 129, 134, 36/124, 67 A, 128, 67 R

[56] References Cited

U.S. PATENT DOCUMENTS

| | | | |
|---|---|---|---|
| 1,422,716 | 7/1922 | Jones | 36/134 |
| 1,493,856 | 5/1924 | Golden | 36/134 |
| 1,557,157 | 10/1925 | Golden | 36/134 |
| 1,594,056 | 7/1926 | Floyd | 36/134 |
| 1,617,418 | 2/1927 | Richardson | 36/126 |
| 3,327,411 | 6/1967 | Roberts | 36/25 |
| 3,755,929 | 9/1973 | Frisch et al. | 36/127 |
| 4,212,120 | 7/1980 | Bowerman et al. | 36/129 |

FOREIGN PATENT DOCUMENTS

| | | | |
|---|---|---|---|
| 159249 | 4/1954 | Australia | 36/126 |
| 2481086 | 10/1981 | France | 36/129 |

*Primary Examiner*—Werner H. Schroeder
*Assistant Examiner*—Mary A. Ellis

[57] ABSTRACT

Cleated shoes for baseball and softball players wherein a minimum of two blade like cleats are provided. One of the cleats is placed under the first metatarsal head of the wearer. The cleats are oriented relative to the center line of the foot determined by a positioning line for each cleat that is perpendicular to the cleats and angled about 45° relative to a forward projection of the center line, one positioning line being clockwise and the other counterclockwise to the center line.

7 Claims; 5 Drawing Figures

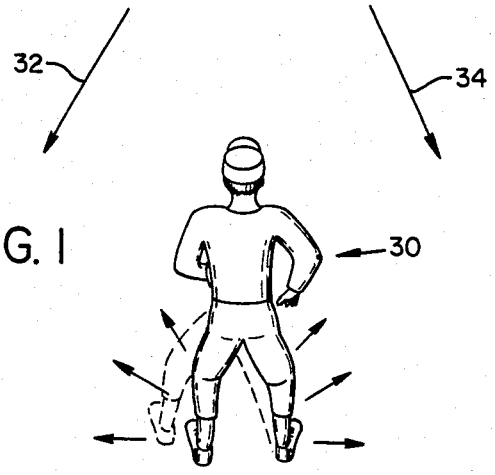
FIG. 1
FIG. 2
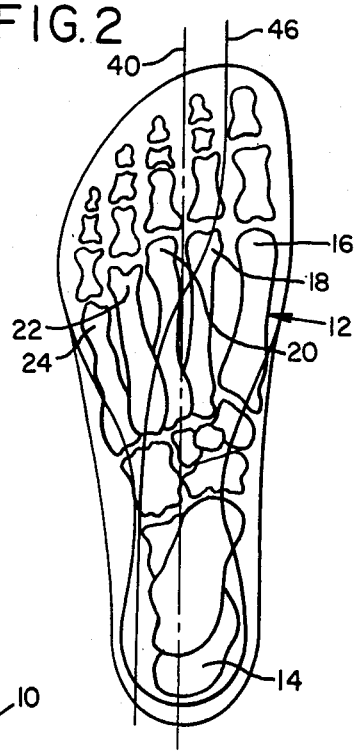
FIG. 3
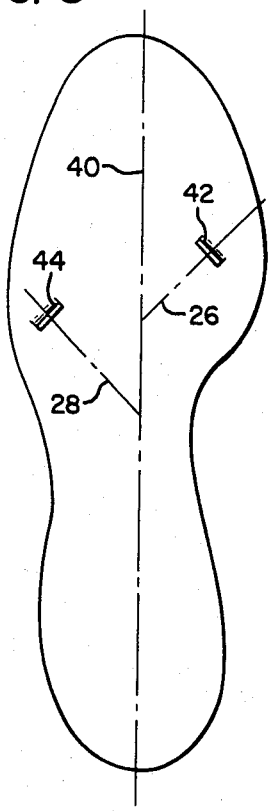
FIG. 4
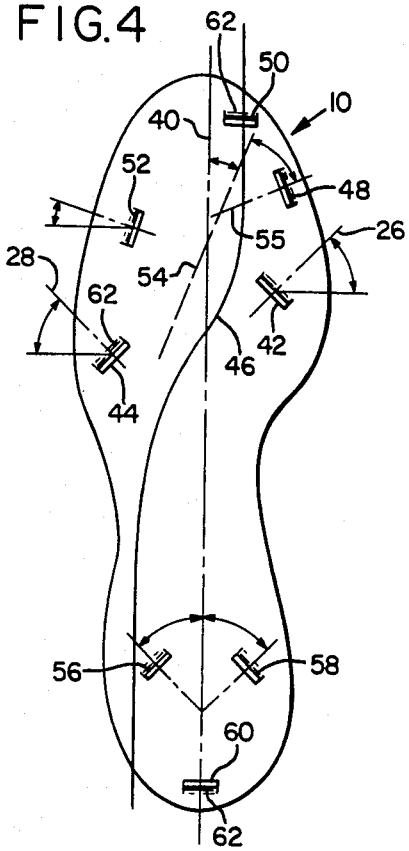
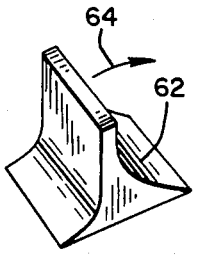
FIG. 5

CLEATED SHOES

FIELD OF INVENTION

This invention relates to shoes equipped with cleats for improved traction, particularly shoes equipped with blade type cleats adapted for outdoor sports e.g. baseball and softball.

HISTORY OF INVENTION

Outdoor sports, like baseball, require the players to start and stop, shift side to side and back and forth on less than stable footing, i.e. on grass and dirt. Long ago players recognized the advantage of adding cleats to the bottoms of their shoes to reduce slipping. Over the years the cleats and the pattern of the cleats on the shoe have been subjected to numerous changes. At first the cleats were provided in the form of metal spikes. The sharp spikes easily penetrated the ground surface and gave the wearer traction in any direction. However, these spikes were also dangerous and particularly to other players, e.g. where a base runner slides into a base being protected by an opposing player.

Making the cleats safer meant eliminating the sharp points. A round, blunt ended cleat is far safer but will not readily penetrate the ground surface in most playing conditions. Thus, a blade-like cleat was developed as the preferred cleat for baseball and softball shoes.

The patterns that have been developed in positioning the blade type cleats on the shoes are also numerous. It has always been recognized that a cleat positioned optimally for forward movement has little value in aiding lateral movement and vise versa. Whereas a baseball player requires sure start-up traction in every direction, the tendency has been to simply provide enough cleats at enough variations in angle within the weight bearing portion of the shoe to insure start-up traction regardless of the direction. The problem that developed was that numerous cleats required more force to achieve penetration and often the required force exceeded the players weight. Also with such random positioning, the player's weight wasn't balanced on the cleats, resulting in uneven penetration which was uncomfortable if not harmful to the player's feet and ankles.

BRIEF DESCRIPTION OF THE INVENTION

The present invention is believed to provide a much improved baseball shoe by a placement of the cleats that is based on a combination of anatomical and geometric characteristics. In general, a minimum number of the cleats are positioned at points where high weight concentration occurs and are oriented to generate the optimum traction regardless of the direction of movement. In its simplest form, a first cleat is placed under the first metatarsal head and a second cleat under the fifth metatarsal head of the player's foot. The first cleat is oriented to be perpendicular to a line that is angled clockwise 45° to the center line of the foot, and the second cleat is oriented to be perpendicular to a line that is angled, counterclockwise 45° to the center line of the foot. Considering that maximum traction is achieved by movement perpendicular to the orientation of the cleat, movement in the medial direction (toward the inside of the foot) is stablized by the first cleat and will vary from 50% effective at a direct sideward movement, to a 100% effectiveness at 45°, and back to 50% at a direct forward movement. This is true for the second cleat where lateral movement is involved (toward the outside of that foot). Furthermore, at points where the effectiveness of the cleat drops towards 50%, the cleats cooperate to enhance traction as will be explained further hereafter.

DETAILED DESCRIPTION INCLUDING DRAWINGS

The advantages of the invention and the concept itself will be more readily understood and appreciated by reference to the following detailed description and drawings wherein:

FIG. 1 illustrates a baseball player in various fielding positions for which the invention is adapted;

FIG. 2 is a bottom view of a player's foot outlined by a baseball shoe and particularly indicating the relative positions of the bone structure of the foot within the shoe;

FIG. 3 is a view of the bottom of a baseball shoe in accordance with this invention;

FIG. 4 is the bottom view of a baseball shoe illustrating an alternative embodiment of the invention; and FIG. 5 illustrates the preferred cleat configuration.

Reference is first made to FIG. 2 wherein a shoe 10 and wearer's foot 12 is outlined including the bone structure of the foot. It will be understood that a shoe is made to fit a foot of a particular size. When properly fitted the same general relationship exists between a wearer's foot, regardless of size, and the shoe that it is fitted to. Hereafter in explaining that relationship the proper fit of the shoe is presumed. The bone structure is important to determine the pressure points on the shoe, i.e. the areas in the sole of the shoe where the wearer's weight is applied. Very generally, the talus is the weight bearing bone in the ankle and projected from it are the bones of the forefoot and the rearfoot. While in a relaxed stance the wearers weight is generally, evenly divided between the forefoot and rearfoot. The bone that transfers this weight to the rearfoot is the calcaneus or heel bone. The base 14 of the calcaneus is outlined in FIG. 2. Since the calcaneus is angled 18°–21° upward, the weight bearing areas are located at the back part of the bone.

The forefoot is considerably more complex and basically comprised of the lesser tarsus and five major bones referred to as the first, second, third, fourth and fifth metatarsal, and the phalanges (digits). The weight from the tarsus is transferred through the lesser tarsus and into the metatarsal bones to the metatarsal heads which collectively define the ball of the foot, the term that is understood by the layman. The metatarsal heads are outlined in FIG. 2 as indicated by reference lines 16, 18, 20, 22 and 24. Of the weight carried in the forefoot, roughly two sixths of the weight is transferred to the first metatarsal head 16. This is the position of the tibial and fibular sesmoids (two bones which sit just underneath the first metatarsal head). One sixth of the weight is carried by each of the other four metatarsal heads. The toe bones are called phalanges which receive weight as the player leans forward as in running. (For further explanation of how weight is distributed to the forefoot refer to Amer. J. Anat. 681-39, Jones, RL 1940.)

Referring now to FIG. 1, a baseball player 30 is illustrated in a fielding position in readiness to field a baseball that may be hit to his general area. His knees are bent and his weight is positioned mostly over the balls of his feet, but evenly divided between his feet. A baseball that is hit sharply to his left as indicated by directional arrow 32, will require instant and direct sideward movement as illustrated in dash lines. This initial movement from a stationary position is hereafter referred to as pushing off and involves a digging in of various parts of the left and right feet. In the sideward movement to the left, the player first digs in with his right foot and at the same time rolls his weight toward the instep of that foot. At the same time, his left foot is raised and partially turned toward the direction of movement as the first short step with the left foot is taken. The player's weight is then transferred to the left foot and the weight is again rolled from the right side or instep of the left foot toward the direction of movement which is now at an angle to the position of the left foot but generally to the outside of that foot. The right foot is raised, crossed over the left foot and brought into alignment with the direction of movement in a conventional, forward running motion. A move to the right for a ball that is hit sharply to the right as indicated by directional arrow 34 is accomplished in exactly the same way but opposite thereto.

Referring now to a forward start as for example in base running and the like, it will be appreciated that if the left foot is the lead off foot, the runner rolls his weight forward and pushes off with his right foot against the ball and toes of that foot. Starting off at angles between straight ahead and full sideward movement involves a combination of the above and in each case a pushoff is effected by planting the pushoff foot while rolling the weight toward the direction of movement. An understanding of this transfer of weight is important for a full appreciation of the improvements provided by the invention as will be now explained.

Reference is now made to FIGS. 2 and 3 which, as has been explained, are bottom views of the player's foot and shoe. It is considered important to provide balanced support for the player's foot. This is achieved by locating the cleats on the shoe to correspond to the bone structure of that foot. As has been explained, the player's weight is distributed between the forefoot and the rearfoot. The weight bearing portion of the forefoot is made up of five major bones that collectively and cooperatively provide an oval-like support base for the weight distributed to the forefoot which is referred to as the ball of the foot. A single cleat under the ball of the foot will not provide the desired traction in the forward and sideward movements and thus a minimum of two cleats is provided for the forefoot, one cleat 42 under the first metatarsal head and the other cleat 44 under the fifth metatarsal head.

It will be appreciated that traction for pushoff is optimally achieved with the cleats oriented with their broad faces perpendicular to the direction of pushoff. Obviously a pair of cleats cannot provide optimum pushoff traction for the variation of directional movements required of a baseball fielder. However, orienting the cleats with their broad faces perpendicular to forwardly directed lines 26 and 28 that are clockwise and counterclockwise respectively to center line 40, does achieve the optimum balance of traction covering movement from 90° clockwise to 90° counterclockwise of the center line.

Note that for a forward movement exactly 45° clockwise to center line 40, cleat 44 has little effect in developing traction. But recall that the weight is shifting toward the direction of movement, i.e., over to the first metatarsal head, the location of cleat 42, which is optimally oriented for such movement.

Consider a movement exactly 90° clockwise to center line 40. At the instant of pushoff, cleat 44 is embedded and is 50% effective, as is cleat 42. As the weight is again shifted to the first metatarsal head the effectiveness of cleat 44 is lost and final pushoff is achieved with the 50% effectiveness of cleat 42.

A forward pushoff, i.e., in the direction of center line 40, is achieved with both cleats embedded and each having a 50% effectiveness. The shifting of weight forward transfers weight from the rearfoot to the forefoot but because the foot planarflexes (bends backward), weight is largely retained over the ball of the foot and throughout the pushoff movement (although some of this weight transfers to the phalangeal bones as will be described hereafter).

It will be appreciated that the relationship described above between cleats 42 and 44 for 45° and 90° medial movement (clockwise to center line 40) can be similarly explained for 45° and 90° lateral movement but with cleat 44 having the major role in creating traction. Also it will be understood that this relationship can be translated into any angle of forward movement.

Under field conditions where additional cleats can be tolerated and maximum traction is desired, three additional cleats may be beneficially added to the forefoot and three cleats added to the rearfoot. Reference is made to FIG. 4 wherein cleats 48, 50 and 52 are added to the forefoot. Again these cleats are provided to optimize the anatomical and geometric balance of the foot as the player pushes off at the various angles during play. As the player raises his heel in preparation for running or fielding, he effectively rolls his weight forward on the ball of his foot. Phalanges, which carry little or no weight in a normal stance, now absorb some of the weight and cleats located under the phalanges will effectively dig in and assist in pushoff. Cleat 48 is placed under the interphalangeal joint of the hallux which is particularly effective for medial pushoff. Cleat 50 is placed at the first interspace between the distal heads of the first and second phalanx i.e. in the distal aspect of the first interspace. This position is on the stress line 46 that develops as the weight is shifted forward on the foot and is the most forward point at which the bone structure of the foot bears against the shoe sole in a forward pushoff movement. (For further explanation of this stress line through the foot refer to Normal and Abnormal Function of the Foot p.p. 175–178, Clinical Biochemical Corporation, Los Angeles, Calif., Root, M. L., Orien W. and Weed J 1977).

Cleat 52 is placed between cleats 50 and 44 to increase traction when the player shifts his weight forward thus distributing weight to the digits. Cleat 52 will now allow a more effective lateral movement. This point is determined by following the contour of the shoe sole and placing the cleat 52 at a generally midposition between cleats 50 and 44, approximately over the intermediate phalanx of the fourth digit.

Cleat 50 is oriented with its broad faces perpendicular to the center line 40 to maximize forward thrust. Cleats 48 and 52 are oriented to primarily assist medial and lateral pushoff movement. A slight variation is however taken into consideration. In a typical stationary stance, a player has both his feet turned outwardly on the average of about 20° from the center line of his body. In FIG. 4, line 54 is 20° clockwise to center line 40 and thus is parallel with the center line of the player's body in a stationary stance (sometimes referred to as the saggital plane.) Cleat 52 is oriented with its broad faces parallel to line 54. Cleat 52 will now assist in lateral motion because it will be perpendicular to a pushoff in a direct lateral motion of the body from the stance position. Also, because of its obliquity it will be somewhat effective in base running where the feet are pointed closer to the direct line of movement. Cleat 48 is oriented with its broad faces perpendicular to a forwardly directed line 55 that is 45° clockwise to line 54. This orientation of cleat 48 compensates for the deminished effect of cleat 42 in the stance position. The broad faces of cleat 48 will now actually be 45° from the sagital plane of the body (taking into account the 20° external rotation of the foot in the stance position). The reasoning behind the orientation of cleat 48 is similar to the reasoning put forth for cleat 42.

Referring now to the rearfoot, based on a series of X-Ray observations, it has been determined that the base of the calcaneus is approximately one half the width of the fleshy outer borders of the heel. Using the point between the medial and lateral tubercles of the calcaneous as a reference point, two cleats 56 and 58 are placed at the edge of the calcaneous at positions that are on lines angled 45° clockwise and counterclockwise respectfully to the center line 40. The cleats are oriented with their broad faces perpendicular to these positioning lines. A third cleat 60 is located at the posterior edge of the calcaneus and is oriented perpendicular to the center line 40. These three cleats create a triangle with the weight being centrally distributed from a point located between the medial and lateral tubercles of the calcaneus.

In a shoe actually constructed in accordance with the above and adapted to fit a shoe size of 7½, the length of the forefoot cleats were 20 millimeters in length and the rearfoot cleats were 16 millimeters in length, each being 4 millimeters in width. Cleat 42 located under the first metatarsal head was 48 millimeters from cleat 48 (center to center in each case). Cleat 48 was 28 millimeters from cleat 50, which was 49 millimeters from cleat 52. Cleat 44 was 54 millimeters from cleat 52 and 71 millimeters from cleat 42.

In the rearfoot portion of the shoe, cleats 56 and 58 were positioned 25 millimeters from the reference point between the medial and lateral tubercles, and cleat 60 slightly further at 28 millimeters.

The cleats are preferably made from molded polyurethane to further reduce injury. Whereas this material is tough it is proposed that an additional thickness 62 be provided at the base, particularly on the side of the cleat toward which a bending moment 64 is applied. The cleats in the forefoot are primarily used for pushing off which generally creates an outwardly directed force on the end of the cleats and the buildup 62 is therefore provided on the front side of the cleats.

The cleats in the rearfoot portion of the shoe function primarily to resist slipping of the foot forwardly and thus the cleats are urged rearward and the buildup 62 is provided on the rear side of each of the heel cleats.

The benefits of the balancing effects achieved by this invention will be readily recognized by those skilled in the art. Certainly some variation in the angles and locations may be permitted while substantially still realizing these benefits, and 5° variation is considered well within the range of acceptability. Also, recognizing that in a stationary stance the wearer's feet may be 20° offset from the center line of the body, the two cleats 42 and 44 in the embodiment of FIG. 2 may be beneficially oriented relative to the body's center line rather than the center line of the foot, or somewhere in between these two angles.

Whereas two embodiments of the invention have been illustrated, one with the mininum number of cleats i.e., two cleats, and the other with the maximum number of cleats that are believed will benefit performance, i.e. eight cleats, it will be appreciated that different combinations of fewer than eight are available. For example, if three cleats are desireable, of course cleats 42 and 44 are considered necessary and the third cleat believed to most beneficially contribute to performance is cleat 50. A fourth cleat would be a single cleat positioned on the heel oriented perpendicular to center line 40 and located at the approximate center of cleats 56, 58 and 60.

Other improvements and modifications may be conceived once the concept is fully appreciated. All of the variations, modifications and improvements are contemplated herein as encompassed by the claims appended hereto.

I claim:

1. A cleated shoe adapted to provide traction for a wearer on a turflike substrate when movement is generated through a broad range of angular directions including forward movement as determined by the center line of the shoe which extends from the heel of the shoe forwardly to the toe thereof, comprising; said shoe having a substrate engaging shoe bottom, a forefoot portion of the shoe bottom adapted to cover the bottom of the forefoot of the wearer and a heel portion adapted to cover the bottom of the rearfoot of the wearer, said forefoot portion having a first designated position for support of the first metatarsal head of the wearer's foot, and a second designated position for support of the fifth metatarsal head of the wearer's foot, a first bladelike cleat having opposed broad faces affixed to the shoe bottom at said first position and a second bladelike cleat having opposed broad faces affixed to the shoe bottom at said second position, said first cleat oriented relative to the center line whereby a line (26) perpendicular to the broad faces of the cleat is forwardly projected from the center line in an angular range of about 40° to 70° relative to the center line, and said second cleat is oriented to the center line whereby a line (28) perpendicular to the broad faces of the cleat is forwardly projected from the center line in an angular range of about 20° to 50° relative to the center line.

2. A cleated shoe as defined in claim 1 wherein the first and second cleats are oriented relative to the center line whereby the lines (26) (28) perpendicular to the broad faces thereof are angled about 45° relative to the center line.

3. A cleated shoe as defined in claim 2 wherein the forefoot portion of the shoe bottom has a third designated position under the hallux interphalangeal joint of the wearer, a fourth designated position adjacent the distal head of the hallux at the first interspace, and a fifth designated position intermediate of the fourth and second designated positions, and third, fourth and fifth bladelike cleats affixed to the shoe bottom at each of said third, fourth and fifth designated positions.

4. A cleated shoe as defined in claim 3 wherein said rearfoot portion of the shoe bottom has a sixth designated position at the posterior of the support area for the calcaneus of the wearer, and seventh and eighth designated positions at the edge of the support area at about 45° angles clockwise and counterclockwise respectfully from the center line projected forwardly from the center of the calcaneus, and sixth, seventh and eighth bladelike cleats affixed to said sixth, seventh and eighth designated areas in the rearfoot portion.

5. A cleated shoe as defined in claim 3 wherein the fifth bladelike cleat is oriented with its broad faces parallel to a body line that is angled about 20° medially and forwardly relative to the center line of the shoe, said third cleat is oriented with its broad faces perpendicular to a positioning line that is angled forwardly relative to the body line about 45°, and said fourth cleat is oriented with its broad faces perpendicular to the center line.

6. A cleated shoe as defined in claim 5 wherein said rearfoot portion of the shoe bottom has a sixth designated position at the posterior of the support area for the calcaneus of the wearer, and seventh and eighth designated positions at the edge of the support area at positions determined by directional lines at about 45° angles clockwise and counterclockwise respectively from the center line projected forwardly from the center of the calceneus, and sixth, seventh and eighth bladelike cleats affixed to said sixth, seventh and eighth designated positions of the rear foot portion, said sixth bladelike cleat oriented with its broad faces perpendicular to the center line and said seventh and eighth bladelike cleats oriented with their broad faces perpendicular to the lines defining the 45° angles.

7. A cleated shoe as defined in claim 1 wherein the second cleat is oriented with its broad faces perpendicular to the broad faces of said first cleat for cooperative pushoff traction.

* * * * *